US011107433B2

(12) United States Patent
Guo et al.

(10) Patent No.: US 11,107,433 B2
(45) Date of Patent: Aug. 31, 2021

(54) DATA TRANSMISSION METHOD, DATA TRANSMISSION CIRCUIT, DISPLAY DEVICE AND STORAGE MEDIUM

(71) Applicants: BEIJING BOE DISPLAY TECHNOLOGY CO., LTD., Beijing (CN); BOE TECHNOLOGY GROUP CO., LTD., Beijing (CN)

(72) Inventors: Jun Guo, Beijing (CN); Xin Wang, Beijing (CN); Xin Duan, Beijing (CN); Jieqiong Wang, Beijing (CN); Ming Chen, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 1 day.

(21) Appl. No.: 16/619,033

(22) PCT Filed: Jun. 4, 2018

(86) PCT No.: PCT/CN2018/089744
§ 371 (c)(1),
(2) Date: Dec. 3, 2019

(87) PCT Pub. No.: WO2018/223915
PCT Pub. Date: Dec. 13, 2018

(65) Prior Publication Data

US 2020/0090618 A1 Mar. 19, 2020

(30) Foreign Application Priority Data

Jun. 9, 2017 (CN) ..... 201710433373.1

(51) Int. Cl.
*G09G 3/36* (2006.01)
*G09G 3/20* (2006.01)

(52) U.S. Cl.
CPC ..... *G09G 3/3688* (2013.01); *G09G 3/2096* (2013.01); *G09G 2310/08* (2013.01); *G09G 2370/08* (2013.01)

(58) Field of Classification Search
CPC combination set(s) only.
See application file for complete search history.

(56) References Cited

U.S. PATENT DOCUMENTS

2008/0129713 A1 6/2008 Chen et al.
2012/0056869 A1 3/2012 Cha et al.
(Continued)

FOREIGN PATENT DOCUMENTS

CN 101197114 A 6/2008
CN 102542971 A 7/2012
(Continued)

OTHER PUBLICATIONS

"First Office Action and English language translation", CN Application No. 201710433373.1, dated Oct. 22, 2020, 22 pp.
(Continued)

*Primary Examiner* — William Boddie
*Assistant Examiner* — Alecia D English
(74) *Attorney, Agent, or Firm* — Myers Bigel, P.A.

(57) ABSTRACT

This application discloses a data transmission method, a data transmission circuit, a display device and a storage medium, and relates to the field of display manufacturing. The method is used for a timing controller, the method including sending a link stability check data to a source driver after clock calibration, receiving feedback information sent by the source driver, where the feedback information is generated by the source driver when judging that the received link stability check data is correct, and sending target data to the source driver based on the feedback information.

16 Claims, 7 Drawing Sheets

(56) References Cited

U.S. PATENT DOCUMENTS

| | | | | |
|---|---|---|---|---|
| 2012/0146965 | A1 | 6/2012 | Baek et al. | |
| 2012/0206465 | A1 | 8/2012 | Yang | |
| 2012/0242628 | A1* | 9/2012 | Yuan | G09G 3/3611 345/204 |
| 2013/0113777 | A1* | 5/2013 | Baek | G09G 3/20 345/212 |
| 2014/0078133 | A1* | 3/2014 | Lee | G09G 3/2092 345/213 |
| 2015/0154943 | A1 | 6/2015 | Lee et al. | |
| 2016/0125840 | A1 | 5/2016 | Oh et al. | |
| 2016/0284313 | A1* | 9/2016 | Lin | G09G 5/18 |
| 2018/0101034 | A1 | 4/2018 | Xiong | |
| 2018/0286344 | A1* | 10/2018 | Yang | G09G 5/18 |

FOREIGN PATENT DOCUMENTS

| | | | |
|---|---|---|---|
| CN | 102637420 | A | 8/2012 |
| CN | 102930808 | A | 2/2013 |
| CN | 103106861 | A | 5/2013 |
| CN | 103218966 | A | 7/2013 |
| CN | 104052577 | A | 9/2014 |
| CN | 104064161 | A | 9/2014 |
| CN | 105590584 | A | 5/2016 |
| CN | 105719587 | A | 6/2016 |

OTHER PUBLICATIONS

"Communication with Supplementary European Search Report", EP Application No. 18812733.6, dated Jan. 29, 2021, 20 pp.

* cited by examiner

DATA TRANSMISSION METHOD, DATA TRANSMISSION CIRCUIT, DISPLAY DEVICE AND STORAGE MEDIUM

CROSS REFERENCE TO RELATED APPLICATIONS

The present application is a 35 U.S.C. 371 national stage application of PCT International Application No. PCT/CN2018/089744, filed on Jun. 4, 2018, which claims the benefit of Chinese Patent Application No. 201710433373.1, filed on Jun. 9, 2017, the entire disclosures of which are incorporated herein by reference.

TECHNICAL FIELD

This application relates to the field of display manufacturing, and in particular, to a data transmission method, a data transmission circuit, a display device and a computer readable non-transitory storage medium.

BACKGROUND

A point-to-point (P2P for short) interface is a high speed serial interface applied between a timing controller (T-CON for short) and a source driver (SD for short) inside a display panel of a liquid crystal display. Transmission of data such as display data and configuration data, etc. may be accomplished through the P2P interface.

In the related art, there is a data transmission method in which the timing controller and the source driver perform a clock calibration operation first, and then the timing controller sends data needing to be transmitted to the source driver.

SUMMARY

Embodiments of the disclosure provide a data transmission method, a data transmission circuit, a display device and a non-transitory storage medium. The technical solutions are as follows.

In a first aspect, there is provided a data transmission method for a timing controller, the method including: sending link stability check data to a source driver after clock calibration; receiving feedback information sent by the source driver, wherein the feedback information is generated by the source driver when judging that the received link stability check data is correct; and sending target data to the source driver based on the feedback information.

Exemplarily, the sending the link stability check data to a source driver includes: sending the link stability check data to the source driver when the timing controller is to enter a low power consumption wake-up state, wherein the low power consumption wake-up state is a transitional state in which the timing controller reenters a data transmission state from a low power consumption state with no need for data transmission.

Exemplarily, the link stability check data is obtained by encoding a multiple byte data code adopting an 8b/10b encoding approach, the multiple byte data code includes a start identification and data digits, the start identification is used for indicating start of data transmission, the data digits carry verification data, a scrambling identification is arranged in the data digits, a position of the scrambling identification is used for indicating a port of the source driver and an initialization time point of a linear feedback shift register LFSR corresponding to the port, and the LFSR is used for scrambling of the target data.

Exemplarily, the multiple byte data code is a data code of 40 bytes, the start identification is a K2 code of 4 bytes, the scrambling identification is a K3 code of 4 bytes, the verification data carried by the data digits includes 8 data units, each of the data units includes a data code of 4 bytes, and there exists at least a data code of 4 bytes between the start identification and the scrambling identification.

Exemplarily, the sending the link stability check data to a source driver includes: sending for a duration of 1 microsecond the link stability check data to the source driver n times, n being greater than or equal to 5.

Exemplarily, after the sending the link stability check data to a source driver, the method further includes: generating the link stability check data containing an interruption identification in response to receiving a transmission interruption instruction; and sending the link stability check data containing the interruption identification to the source driver, to instruct the source driver to stop receiving the link stability check data.

Exemplarily, the interruption identification is a K1 code or a K4 code.

Exemplarily, the target data is display data or configuration data.

In a second aspect, there is provided a data transmission method for a source driver, the method including:

receiving link stability check data sent by a timing controller after clock calibration; judging whether the received link stability check data is correct; and generating feedback information in response to the received link stability check data being correct, and sending the feedback information to the timing controller, such that the timing controller sends target data to the source driver based on the feedback information.

Exemplarily, the link stability check data is obtained by encoding a multiple byte data code adopting an 8b/10b encoding approach, the multiple byte data code includes a start identification and data digits, the start identification is used for indicating start of data transmission, the data digits carry verification data, a scrambling identification is arranged in the data digits, a position of the scrambling identification is used for indicating a port of the source driver and an initialization time point of a linear feedback shift register LFSR corresponding to the port, and the LFSR is used for scrambling of the target data.

Exemplarily, the multiple byte data code is a data code of 40 bytes, the start identification is a K2 code of 4 bytes, the scrambling identification is a K3 code of 4 bytes, the verification data carried by the data digits includes 8 data units, each of the data units includes a data code of 4 bytes, and there exists at least a data code of 4 bytes between the start identification and the scrambling identification.

Exemplarily, the receiving the link stability check data sent by a timing controller after clock calibration includes: receiving for a duration of 1 microsecond the link stability check data sent n times by the timing controller, n being greater than or equal to 5.

Exemplarily, after the receiving the link stability check data sent by a timing controller after clock calibration, the method further includes: stopping receiving the link stability check data in response to receiving the link stability check data containing an interruption identification sent by the timing controller, the link stability check data containing an interruption identification being generated by the timing controller when receiving a transmission interruption instruction.

Exemplarily, after the judging whether the received link stability check data is correct, the method further includes: repeatedly performing a phase calibration operation in response to the received link stability check data being incorrect, until a correct link stability check data is received.

Exemplarily, the judging whether the received link stability check data is correct includes: decoding the received link stability check data to obtain decoded data, wherein the decoded data includes the scrambling identification; judging whether the decoded data is the same as the multiple byte data code; determining that the received link stability check data is correct in response to the decoded data being the same as the multiple byte data code; and determining that the received link stability check data is incorrect in response to the decoded data being different from the multiple byte data code.

Exemplarily, after the determining that the received link stability check data is correct, the method further includes: determining the port of the source driver and the initialization time point of the linear feedback shift register LFSR corresponding to the port according to the position of the scrambling identification in the decoded data; and initializing the LFSR for the port according to the initialization time point.

In a third aspect, there is provided a data transmission circuit for a timing controller, the data transmission circuit including: a first sender for sending the link stability check data to a source driver after clock calibration; a receiver for receiving feedback information sent by the source driver, wherein the feedback information is generated by the source driver when judging that the received link stability check data is correct; and a second sender for sending target data to the source driver based on the feedback information.

Exemplarily, the first sender is specifically used for: sending the link stability check data to the source driver when the timing controller is to enter a low power consumption wake-up state, wherein the low power consumption wake-up state is a transitional state in which the timing controller reenters a data transmission state from a low power consumption state with no need for data transmission.

Exemplarily, the link stability check data is obtained by encoding a multiple byte data code adopting an 8b/10b encoding approach, the multiple byte data code includes a start identification and data digits, the start identification is used for indicating start of data transmission, the data digits carry verification data, a scrambling identification is arranged in the data digits, a position of the scrambling identification is used for indicating a port of the source driver and an initialization time point of a linear feedback shift register LFSR corresponding to the port, and the LFSR is used for scrambling of the target data.

Exemplarily, the multiple byte data code is a data code of 40 bytes, the start identification is a K2 code of 4 bytes, the scrambling identification is a K3 code of 4 bytes, the verification data carried by the data digits includes 8 data units, each of the data units includes a data code of 4 bytes, and there exists at least a data code of 4 bytes between the start identification and the scrambling identification.

Exemplarily, the first sender is specifically used for: sending for a duration of 1 microsecond the link stability check data to the source driver n times, n being greater than or equal to 5.

Exemplarily, the data transmission circuit further includes: a generator for generating the link stability check data containing an interruption identification when a transmission interruption instruction is received; and a third sender for sending the link stability check data containing the interruption identification to the source driver, to instruct the source driver to stop receiving the link stability check data.

Exemplarily, the interruption identification is a K1 code or a K4 code.

Exemplarily, the target data is display data or configuration data.

In a fourth aspect, there is provided a data transmission circuit for a source driver, the data transmission circuit including: a receiver for receiving the link stability check data sent by a timing controller after clock calibration; a judger for judging whether the received link stability check data is correct; and a generator for generating feedback information when the received link stability check data is correct, and sending the feedback information to the timing controller, such that the timing controller sends target data to the source driver based on the feedback information.

Exemplarily, the data transmission circuit further includes: a first processor for stopping receiving the link stability check data when the link stability check data containing an interruption identification sent by the timing controller is received, the link stability check data containing an interruption identification being generated by the timing controller when receiving a transmission interruption instruction.

Exemplarily, the data transmission circuit further includes: a second processor for repeatedly performing a phase calibration operation when the received link stability check data is incorrect, until a correct link stability check data is received.

Exemplarily, the judger is specifically used for: decoding the received link stability check data to obtain decoded data, wherein the decoded data includes the scrambling identification; judging whether the decoded data is the same as the multiple byte data code; determining that the received link stability check data is correct in response to the decoded data being the same as the multiple byte data code; and determining that the received link stability check data is incorrect in response to the decoded data being different from the multiple byte data code; wherein the link stability check data is obtained by encoding a multiple byte data code adopting an 8b/10b encoding approach, the multiple byte data code includes a start identification and data digits, the start identification is used for indicating start of data transmission, the data digits carry verification data, the scrambling identification is arranged in the data digits, a position of the scrambling identification is used for indicating a port of the source driver and an initialization time point of a linear feedback shift register LFSR corresponding to the port, and the LFSR is used for scrambling of the target data.

Exemplarily, the judger is further used for: determining the port of the source driver and the initialization time point of the linear feedback shift register LFSR corresponding to the port according to the position of the scrambling identification in the decoded data; and initializing the LFSR for the port according to the initialization time point.

In a fifth aspect, there is provided a display device including a timing controller and a source driver, the timing controller includes a data transmission circuit as described in the third aspect, and the source driver includes a data transmission circuit as described in the fourth aspect.

In a sixth aspect, there is provided a computer readable non-transitory storage medium storing an instruction therein which, when running on a computer, causes the computer to perform any of the described data transmission methods in the first aspect.

In a seventh aspect, there is provided a computer readable non-transitory storage medium storing an instruction therein which, when running on a computer, causes the computer to perform any of the described data transmission methods in the second aspect.

BRIEF DESCRIPTION OF THE DRAWINGS

In order to more clearly illustrate the technical solutions in the embodiments of the disclosure, the appended drawings needing to be used in the description of the embodiments will be introduced briefly in the following. Obviously, the drawings in the following description are only some embodiments of this application, and for the person having ordinary skills in the art, other drawings may also be obtained according to these drawings under the premise of not paying out undue experimentation.

DETAILED DESCRIPTION

To make the objects, technical solutions and advantages of this application clearer, in the following, the implementations of this application will be further described in detail in conjunction with the drawings.

Figure 1:
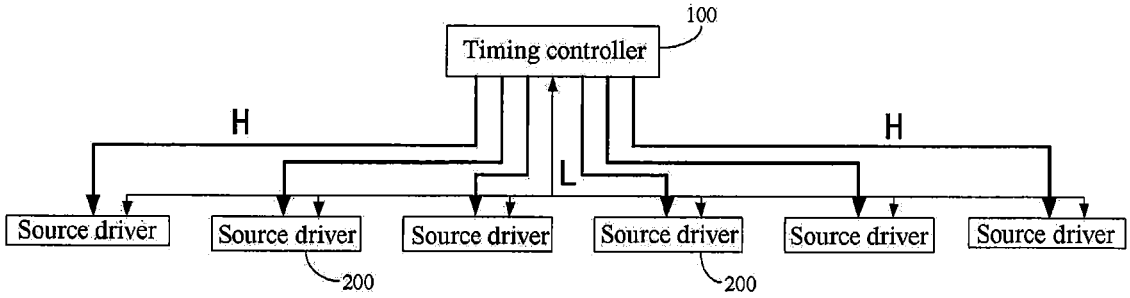
FIG. 1 is a schematic diagram of an application environment of a data transmission method provided by an embodiment of the disclosure.

FIG. 1 shows a schematic diagram of an application environment of a data transmission method provided by an embodiment of the disclosure. As shown in FIG. 1, the data transmission method is applied in a display device, which includes a timing controller 100 and a plurality of source drivers 200. A plurality of high speed signal lines H of the timing controller 100 are coupled to the plurality of source drivers 200 in a one to one correspondence. The timing controller 100 is also coupled to a low speed signal line L, and the plurality of source drivers 200 are connected in parallel and coupled to the low speed signal line L. A P2P interface is a high speed serial interface between the timing controller 100 and a source driver 200, and transmission of data such as display data, configuration data, etc. may be accomplished by the P2P interface. Therein, clock calibration is an important part of the P2P interface technology. In the related art, the timing controller 100 directly sends data after the clock calibration operation is completed, the source driver 200 also directly receives data after the clock calibration operation is completed, a data transmission state of a link between the timing controller and the source driver (also called a P2P interface link) is not detected in advance in the whole procedure, and in a case in which the data transmission state of the link is poor, the timing controller 100 will also send data to the source driver 200, and finally, the source driver 200 is apt to receive erroneous data.

Yet in embodiments of the disclosure, the timing controller 100 and the source driver 200 will detect the data transmission state of the link, and when the data transmission state of the link is good, the timing controller 100 then sends data such as display data and configuration data, etc. to the source driver 200.

Figure 2:
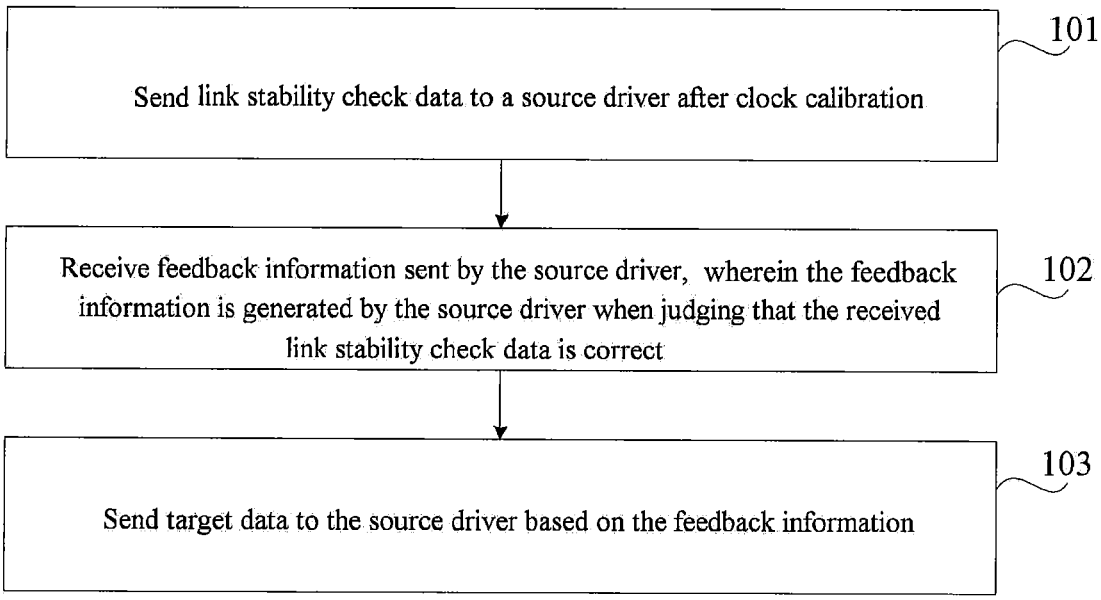
FIG. 2 is a flow chart of a data transmission method provided by an embodiment of the disclosure.

An embodiment of the disclosure provides a data transmission method for the timing controller 100 in the application environment as shown in FIG. 1. As shown in FIG. 2, the method includes the following steps.

At step 101, a link stability check data is sent to a source driver after clock calibration.

The source driver may be any of the source drivers in the application environment as shown in FIG. 1.

At step 102, feedback information sent by the source driver is received, wherein the feedback information is generated by the source driver when judging that the received link stability check data is correct.

At step 103, target data is sent to the source driver based on the feedback information.

From the above, in the data transmission method provided by the embodiment of the disclosure, since the timing controller can send the link stability check data to the source driver, and when the link stability check data received by the source driver is correct, which indicates that the data transmission state of the link is good, the source driver sends feedback information to the timing controller, such that the timing controller can send data to the source driver in a case in which the data transmission state of the link is good, the reliability and stability of data transmission is improved.

Figure 3:
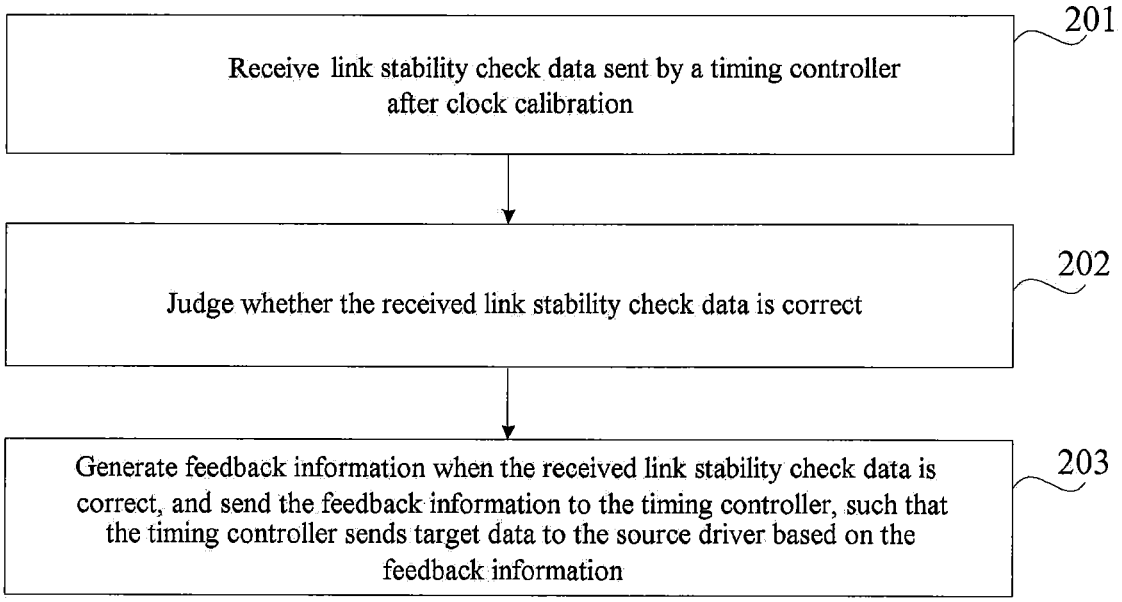
FIG. 3 is a flow chart of another data transmission method provided by an embodiment of the disclosure.

An embodiment of the disclosure provides another data transmission method for any of the source drivers 200 in the application environment as shown in FIG. 1. As shown in FIG. 3, the method includes:

step 201, receiving the link stability check data sent by a timing controller after clock calibration;

step 202, judging whether the received link stability check data is correct; and step 203, generating feedback information when the received link stability check data is correct, and sending the feedback information to the timing controller, such that the timing controller sends target data to the source driver based on the feedback information.

From the above, in the data transmission method provided by the embodiment of the disclosure, the source driver receives link stability check data sent by the timing controller after clock calibration, and when the link stability check data received by the source driver is correct, which indicates that the data transmission state of the link is good, the source driver sends feedback information to the timing controller, such that the timing controller can send data to the source driver in a case in which the data transmission state of the link is good, so the reliability and stability of data transmission is improved.

Figure 4A:
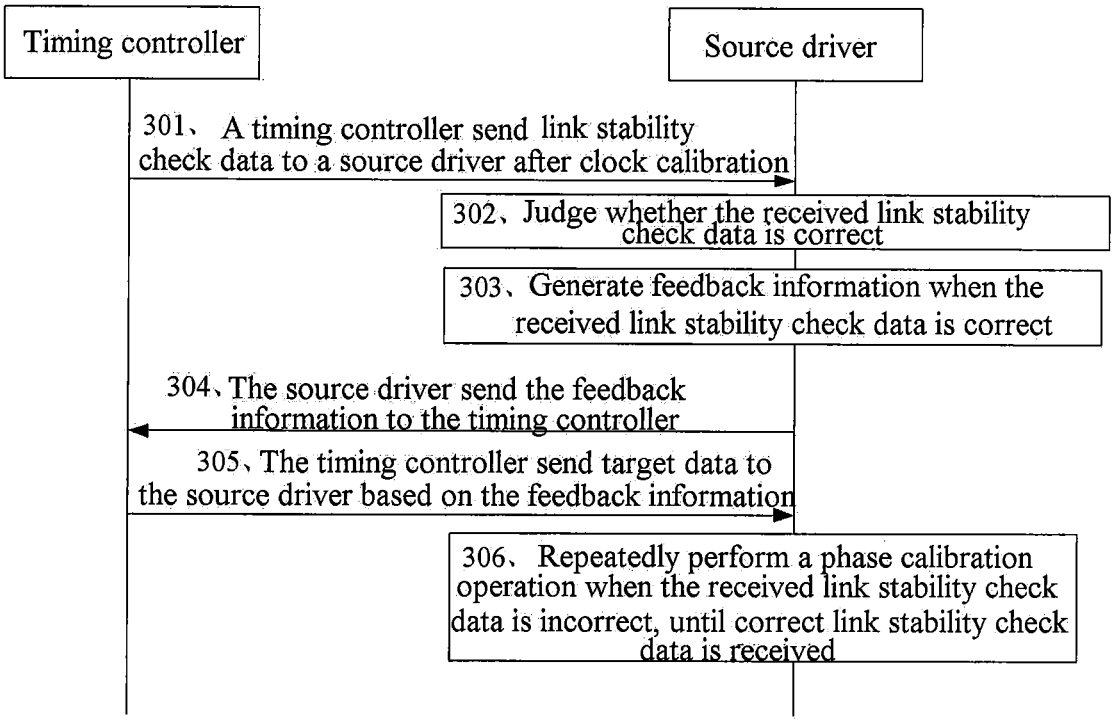
FIG. 4*a* is a flow chart of still another data transmission method provided by an embodiment of the disclosure.

An embodiment of the disclosure provides still another data transmission method for the application environment as shown in FIG. 1. As shown in FIG. 4*a*, the method includes the following steps.

At step 301, a timing controller sends a link stability check data to a source driver after clock calibration. Step 302 is to be performed.

The source driver is any of the source drivers in the application environment as shown in FIG. 1.

On one hand, the timing controller sends the link stability check data to the source driver after the clock calibration.

In the embodiment of the disclosure, the timing controller and the source driver first perform a clock calibration operation, and then, the timing controller sends the link stability check data to the source driver, to detect a data transmission state of a link between the timing controller and the source driver.

On the other hand, after the clock calibration and when the timing controller is to enter a low power consumption wake-up state, the timing controller sends the link stability check data to the source driver, wherein the low power consumption wake-up state is a transitional state in which the timing controller reenters a data transmission state from a low power consumption state with no need for data transmission.

In the embodiment of the disclosure, when the timing controller and the source driver do not need to transmit data, the timing controller enters a low power consumption state. When the timing controller and the source driver need to transmit data again, the timing controller needs to enter a low power consumption wake-up state, to be recovered to a normal working state. When the timing controller is to enter the low power consumption wake-up state, the timing controller may send the link stability check data to the source driver, to detect a data transmission state of a link between the timing controller and the source driver. This method may cause the timing controller to be recovered to the normal working state from the low power consumption wake-up state rapidly.

In the embodiment of the disclosure, when the timing controller and the source driver need to transmit data again, the timing controller and the source driver may be recovered to the normal working state without the need for a clock calibration operation.

It needs to be added that, the step of sending the link stability check data in the embodiment of the disclosure may also be performed when the timing controller is to enter other states, in addition to that this step may be performed when the timing controller is to enter the low power consumption wake-up state. As long as it is to return to the normal working state, the timing controller may send the link stability check data to the source driver to detect the data transmission state of the link between the timing controller and the source driver.

In an embodiment of the disclosure, the timing controller may send an identity identification of the source driver to the source driver while the timing controller sends the link stability check data to the source driver. The source driver may detect whether the identity identification sent by the timing controller is the same as its own identity identification. When the identity identification sent by the timing controller is the same as its own identity identification, the source driver performs corresponding operations, with reference to steps 302 to 304 and step 306, etc.

Exemplarily, the link stability check data is obtained by encoding a multiple byte data code adopting an 8b/10b (namely, encoding 8-bit data into 10-bit data) encoding approach, and the multiple byte data code includes a start identification and data digits.

Therein, the start identification is used for indicating start of data transmission, the data digits carry verification data, a scrambling identification is arranged in the data digits, a position of the scrambling identification is used for indicating a port of the source driver and an initialization time point of a linear feedback shift register (LFSR for short) corresponding to the port, and the LFSR is used for scrambling of target data. Using some special codes such as the start identification, the scrambling identification, etc., it may be possible to assist a receiving end in restoration, and find out a data code transmission error early, and thereby inhibiting errors from continuing to occur.

Therein, the multiple byte data code may be obtained by adopting the 8b/10b encoding approach in the related art. When encoding adopting the 8b/10b encoding approach, it is to encode the verification data carried by the data digits in the multiple byte data code, and there is no need for encoding the special codes (e.g., the start identification, the scrambling identification, etc.).

When encoding adopting the 8b/10b encoding approach, it may be such that the numbers of "0s" and "1s" keep basically consistent, and consecutive "0s" and "1s" do not exceed 5 digits, that is, one digit of "0" must be inserted behind every 5 consecutive "1s", and one digit of "1" must be inserted behind every 5 consecutive "0s", thereby guaranteeing signal DC (direct current) balance.

When encoding the verification data adopting the 8b/10b encoding approach in the related art, in particular, a set of consecutive 8-bit data is divided into two parts, 5B/6B (namely, encoding 5-bit data into 6-bit data) encoding is performed on the first 5 digits thereof, and 3B/4B (namely, encoding 3-bit data into 4-bit data) encoding is performed on the last 3 digits thereof.

However, in the data obtained by encoding adopting the 8b/10b encoding approach in the related art, the boundary between every two sets of 10-bit data is blurry, and a transmission error easily appears. Hence, to ensure that data to be transmitted can be correctly restored at a receiving end, in an embodiment of the disclosure, when encoding the verification data, it may be possible to first encode 8-bit data corresponding to a byte to be encoded of the verification data into 9-bit data, and when the byte to be encoded is not the first byte of the verification data, detect the first digit of data of the 9-bit data and a previous digit of data adjacent to the first digit of data; when the numerical value of the first digit of data is the same as that of the previous digit of data, invert the 9-bit data and then add a tenth digit of data for indicating that the 9-bit data has undergone an inversion operation behind the 9-bit data to obtain 10-bit data; and when the numerical value of the first digit of data is different from that of the previous digit of data, add a tenth digit of data for indicating that the 9-bit data has not undergone an inversion operation behind the 9-bit data to obtain 10-bit data; wherein the 10-bit data is binary data. When the byte to be encoded is the first byte of the verification data, a tenth digit of data for indicating that the 9-bit data has not undergone an inversion operation is added behind the 9-bit data to obtain 10-bit data. In the encoding procedure, the 8-bit data is encoded into 9-bit data first, then a tenth digit is added to obtain 10-bit data, a jumping edge is arranged between every two adjacent 10-bit data, and the tenth digit of data is used for indicating whether the 9-bit data has undergone an inversion operation, which can effectively ensure that the data to be transmitted is correctly restored at the receiving end, and the jumping edge may effectively reduce transmission errors.

Exemplarily, the multiple byte data code is a data code of 40 bytes, wherein the start identification is a K2 code of 4 bytes, the scrambling identification is a K3 code of 4 bytes, the verification data carried by the data digits includes 8 data units, and each of the data units includes a data code of 4 bytes. To accomplish data check for at least one time, there exists at least a data code of 4 bytes between the start identification and the scrambling identification.

In an embodiment of the disclosure, the timing controller is coupled to a plurality of source drivers, each port of each of the source drivers may adopt a descrambling approach for received data, and this descrambling approach corresponds to a scrambling approach adopted by the timing controller for data to be sent. That is, a different port of each of the source drivers adopts a different descrambling approach. Nevertheless, for scrambling the target data, a port of each of the source drivers corresponds to an LFSR. The position of the scrambling identification in the data digits is used for indicating a port of the source driver and an initialization time point of an LFSR corresponding to the port. Exemplarily, when the scrambling identification is a K3 code, after the source driver receives and decodes the link stability check data sent by the timing controller, the source driver will determine a time point for initializing an LFSR of a certain port according to the position of the K3 code in the data digits. If the time point at which the source driver initializes the LFSR for the port is different, the result after descrambling will be different.

Exemplarily, each of the 8 data units included in the verification data may include successively arranged 0xea, 0xeb, 0xec and 0xed, wherein data starting with 0x represents hexadecimal data, and in hexadecimal data, a represents decimal 10, b represents decimal 11, c represents decimal 12, d represents decimal 13, and e represents decimal 14. The source driver achieves the purpose of checking data according to the verification data. When what the source driver receives is correct verification data, it indicates that the data transmission state of the link is good.

Figure 4B:
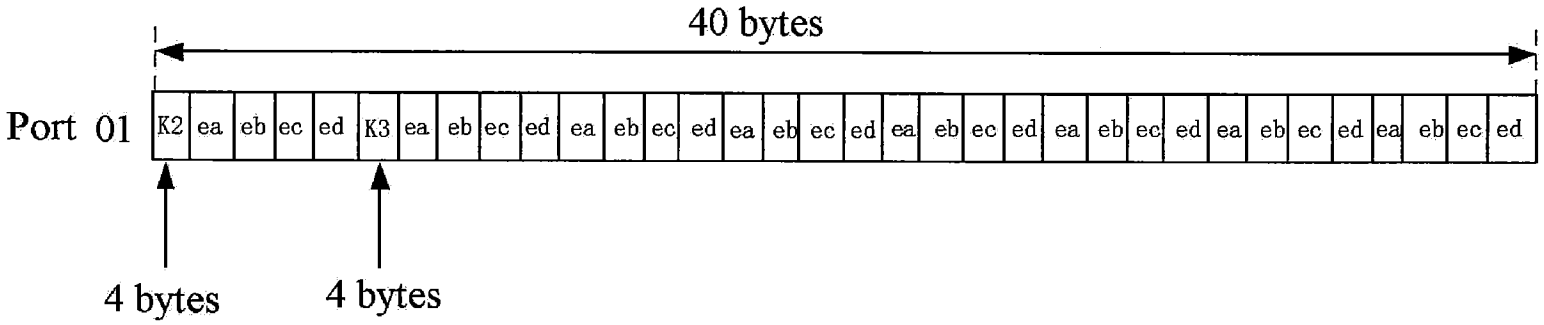
FIG. 4*b* is a schematic diagram of a 40-byte data code sent to a port provided by an embodiment of the disclosure.
Figure 4C:
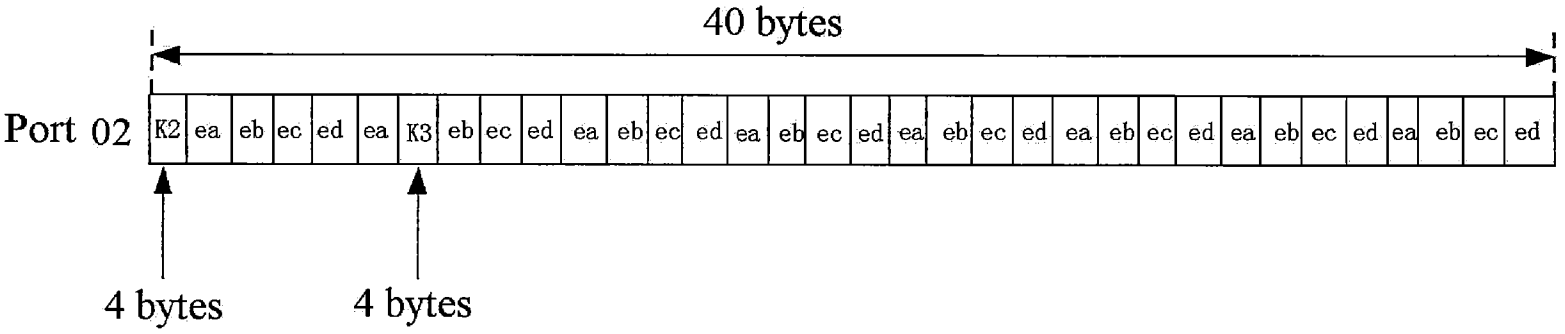
FIG. 4*c* is a schematic diagram of a 40-byte data code sent to another port provided by an embodiment of the disclosure.

Exemplarily, FIG. 4*b* shows a schematic diagram of a 40-byte data code sent to a port 01, and FIG. 4*c* shows a schematic diagram of a 40-byte data code sent to a port 02. The positions of the K3 codes in FIG. 4*b* and FIG. 4*c* are different. Assume that the initialization time point of the LFSR corresponding to the port 01 is t1, and the initialization time point of the LFSR corresponding to the port 02 is t2, and then t2 is different from t1.

Further, for performing multiple time check and initializing the LFSR to reduce the probability of a subsequent error, the step 301 may include: sending for a duration of 1 microsecond the link stability check data to the source driver n times, that is, the total duration in which the timing controller sends the link stability check data to the source driver n times being 1 microsecond, wherein n is greater than or equal to 5.

At step 302, the source driver judges whether the received link stability check data is correct. When the received link stability check data is correct, step 303 is to be performed; and when the received link stability check data is incorrect, step 306 is to be performed.

Figure 4D:
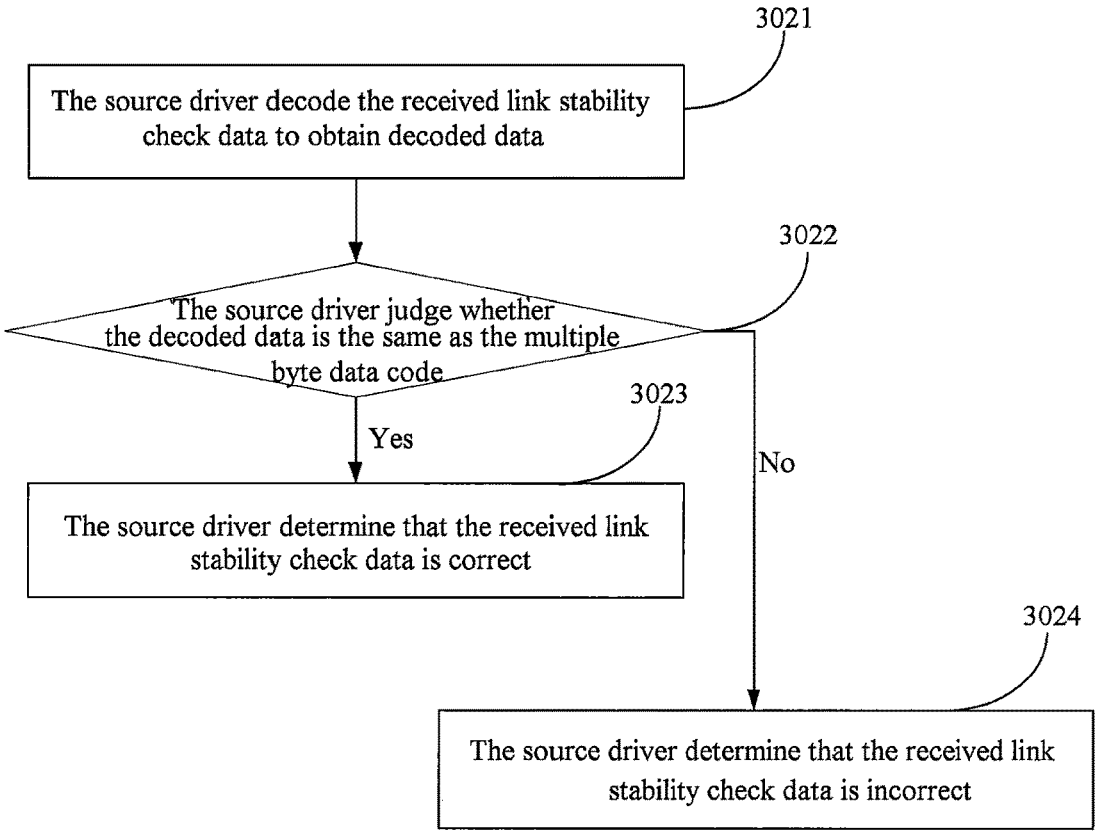
FIG. 4*d* is a flow chart of judging whether link stability check data is correct provided by an embodiment of the disclosure.

In particular, as shown in FIG. 4*d*, the step 302 may include the following steps.

At step 3021, the source driver decodes the received link stability check data to obtain decoded data.

The decoded data includes the scrambling identification, and exemplarily, the decoded data includes a K3 code.

At step 3022, the source driver judges whether the decoded data is the same as the multiple byte data code. When the decoded data is the same as the multiple byte data code, step 3023 is to be performed; and when the decoded data is different from the multiple byte data code, step 3024 is to be performed.

The source driver compares the decoded data with the multiple byte data code before the encoding, to judge whether the two are the same.

At the step 3023, the source driver determines that the received link stability check data is correct.

Based on the step 3022, the source driver judges whether the decoded data is the same as the multiple byte data code before the encoding, and when the decoded data is the same as the multiple byte data code, the source driver determines that the received link stability check data is correct.

Further, after the step 3023, the method may further include:

1) The source driver determines the port of the source driver and the initialization time point of the LFSR corresponding to the port according to the position of the scrambling identification in the decoded data.

When the decoded data is the same as the multiple byte data code, the source driver determines the port of the source driver and the initialization time point of the LFSR corresponding to the port according to the position of the scrambling identification (e.g., the K3 code) in the decoded data. As described above, if the time point at which the source driver initializes the LFSR for the port is different, the result after descrambling will be different, and therefore, the source driver needs to obtain the initialization time point of the LFSR corresponding to the port according to the position of the scrambling identification in the decoded data.

Exemplarily, the source driver may determine a port of the source driver and the initialization time point of an LFSR corresponding to the port according to a correspondence relationship. The correspondence relationship is used for recording a correspondence relationship of a position of a scrambling identification in decoded data, a port of the source driver and an initialization time point of an LFSR. Exemplarily, the correspondence relationship may be as shown in table 1. For example, when the position of the scrambling identification in the decoded data is L1, it may be determined that the port of the source driver is P01, and the initialization time point of the LFSR corresponding to the port P01 is T1. That is, the source driver needs to initialize the LFSR corresponding to the port P01 for the port P01 at the time point T1.

TABLE 1

| Position of the scrambling identification in the decoded data | Port of the source driver | Initialization time point of LFSR |
|---|---|---|
| L1 | P01 | T1 |
| L2 | P02 | T2 |

2) The source driver initializes the LFSR for the port according to the initialization time point.

After obtaining the initialization time point of the LFSR corresponding to the port, the source driver may initialize the LFSR according to the initialization time point, to facilitate scrambling and descrambling of subsequently transmitted data.

At the step 3024, the source driver determines that the received link stability check data is incorrect.

When the decoded data is different from the multiple byte data code before the encoding, the source driver determines that the received link stability check data is incorrect, which indicates that the data transmission state of the link between the timing controller and the source driver is poor, and at this point, it is unsuitable to transmit display data, configuration data, etc.

At the step 303, when the received link stability check data is correct, the source driver generates feedback information. Step 304 is to be performed.

When the link stability check data received by the source driver is correct, the source driver may generate feedback information, and send the feedback information to the timing controller, so as to inform the timing controller that the data transmission state of the current link is good and adapted for transmitting display data, configuration data, etc.

At the step 304, the source driver sends the feedback information to the timing controller. Step 305 is to be performed.

The source driver sends the generated feedback information to the timing controller and informs the timing controller that the data transmission state of the current link is good, and then the timing controller sends target data to the source driver.

At the step 305, the timing controller sends target data to the source driver based on the feedback information.

Exemplarily, the target data is display data or configuration data.

At the step 306, the source driver repeatedly performs a phase calibration operation when the received link stability check data is incorrect, until a correct link stability check data is received.

Exemplarily, when the link stability check data received by the source driver is incorrect, the source driver may repeatedly perform a phase calibration operation to implement phase shift, until a correct link stability check data is received, and in turn the data transmission state of the link is made good and more suitable for transmitting the target data. Then, the steps 303 to 305 are performed again, to complete transmission of the target data.

In an embodiment of the disclosure, the timing controller sends the target data to the source driver only when the source driver has received a correct link stability check data, which improves the reliability and stability of data transmission.

Further, in an embodiment of the disclosure, in the procedure of transmitting the link stability check data, when a user needs to interrupt transmission of the link stability check data, or when an anomaly occurs in the display device, the source driver may stop receiving the link stability check data. In particular, there may be included the following steps.

1. The timing controller generates link stability check data containing an interruption identification when receiving a transmission interruption instruction.

The transmission interruption instruction may be triggered by the user, or may also be triggered when an anomaly occurs to the display device. When the user needs to interrupt transmission of the link stability check data, the user may trigger a transmission interruption instruction, and the timing controller generates link stability check data containing an interruption identification when receiving the transmission interruption instruction. When an anomaly occurs to the display device, a transmission interruption instruction will also be triggered, and the timing controller will also generate the link stability check data containing an interruption identification when receiving the transmission interruption instruction, so that the source driver stops receiving the link stability check data based on the interruption identification.

Exemplarily, the interruption identification is a K1 code or a K4 code. That is, when the source driver receives the K1 code or K4 code, it will stop receiving the link stability check data.

2. The timing controller sends the link stability check data containing the interruption identification to the source driver.

After generating the link stability check data containing the interruption identification, the timing controller sends the link stability check data to the source driver, such that the source driver stops receiving the link stability check data based on the interruption identification.

3. The source driver stops receiving the link stability check data.

When the source driver receives the link stability check data containing the interruption identification (e.g., K1 code or K4 code) sent by the timing controller, the source driver stops receiving the link stability check data.

It needs to be added that, a data transmission method provided by an embodiment of the disclosure is adapted for the P2P interface protocol, this method is adapted for any product or component with the display function adopting the P2P interface protocol, and this method may cause the link between a sending end and a receiving end of a P2P interface to be more stable.

From the above, in the data transmission method provided by the embodiments of the disclosure, the timing controller can send link stability check data to the source driver, and when the link stability check data received by the source driver is correct, which indicates that the data transmission state of the link is good, the source driver sends feedback information to the timing controller, such that the timing controller can only send data to the source driver in a case in which the data transmission state of the link is good. This method causes the link to be more stable, and can cause the timing controller to be rapidly recovered to a normal working state from a low power consumption wake-up state. This method improves the reliability and stability of data transmission.

Figure 5A:
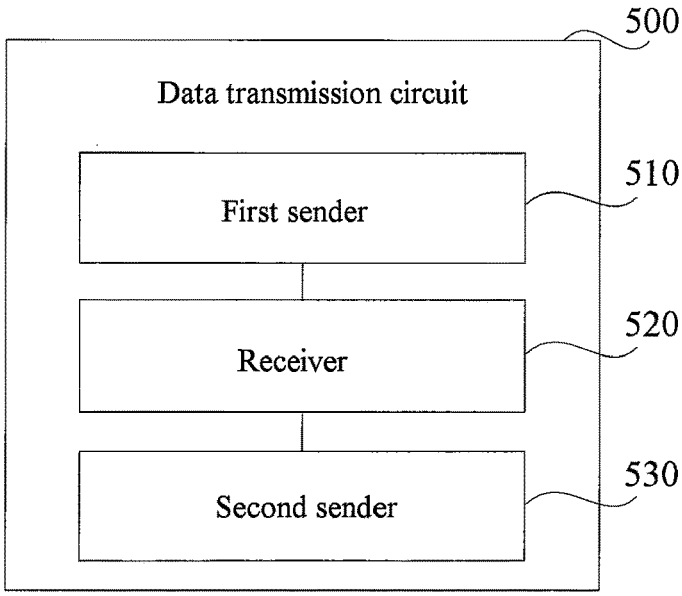
FIG. 5*a* is a structure diagram of a data transmission circuit provided by an embodiment of the disclosure.

An embodiment of the disclosure provides a data transmission circuit for the timing controller 100 in the application environment as shown in FIG. 1, as shown in FIG. 5*a*, the data transmission circuit 500 including:

a first sender 510 for sending the link stability check data to a source driver after clock calibration;

a receiver 520 for receiving feedback information sent by the source driver, wherein the feedback information is generated by the source driver when judging that the received link stability check data is correct; and a second sender 530 for sending target data to the source driver based on the feedback information.

From the above, in the data transmission circuit provided by the embodiment of the disclosure, since the timing controller can send the link stability check data to the source driver, and when the link stability check data received by the source driver is correct, which indicates that the data transmission state of the link is good, the source driver sends feedback information to the timing controller, such that the timing controller can send data to the source driver in a case in which the data transmission state of the link is good, the reliability and stability of data transmission is improved.

Exemplarily, the first sender 510 is specifically used for: sending the link stability check data to the source driver when the timing controller is to enter a low power consumption wake-up state, wherein the low power consumption wake-up state is a transitional state in which the timing controller reenters a data transmission state from a low power consumption state with no need for data transmission.

Exemplarily, the link stability check data is obtained by encoding a multiple byte data code adopting an 8b/10b encoding approach, the multiple byte data code includes a start identification and data digits.

Therein, the start identification is used for indicating start of data transmission, the data digits carry verification data, a scrambling identification is arranged in the data digits, a position of the scrambling identification is used for indicating a port of the source driver and an initialization time point of an LFSR corresponding to the port, and the LFSR is used for scrambling of the target data.

Exemplarily, the multiple byte data code is a data code of 40 bytes, the start identification is a K2 code of 4 bytes, the scrambling identification is a K3 code of 4 bytes, the verification data carried by the data digits includes 8 data units, each of the data units includes a data code of 4 bytes, and there exists at least a data code of 4 bytes between the start identification and the scrambling identification.

Exemplarily, the first sender 510 is specifically used for: sending for a duration of 1 microsecond the link stability check data to the source driver n times, n being greater than or equal to 5.

Figure 5B:
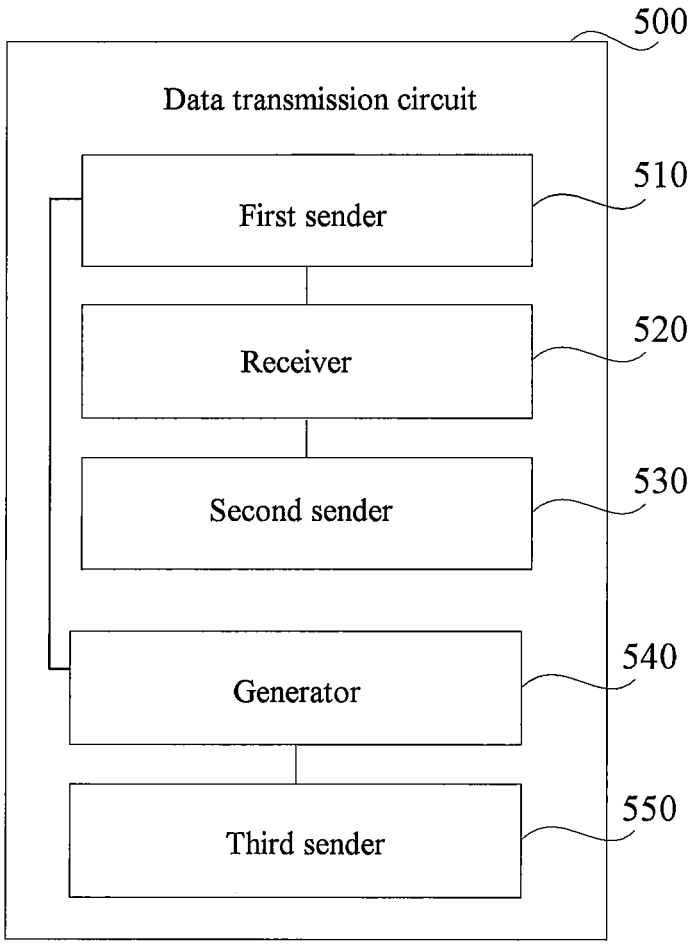
FIG. 5*b* is a structure diagram of another data transmission circuit provided by an embodiment of the disclosure.

Further, as shown in FIG. 5*b*, the data transmission circuit 500 may further include: a generator 540 for generating link stability check data containing an interruption identification when a transmission interruption instruction is received; and a third sender 550 for sending the link stability check data containing the interruption identification to the source driver, to cause the source driver to stop receiving the link stability check data.

Exemplarily, the interruption identification is a K1 code or a K4 code.

Exemplarily, the target data is display data or configuration data.

From the above, in the data transmission circuit provided by the embodiment of the disclosure, since the timing controller can send the link stability check data to the source driver, and when the link stability check data received by the source driver is correct, which indicates that the data transmission state of the link is good, the source driver sends feedback information to the timing controller, such that the timing controller can send data to the source driver in a case in which the data transmission state of the link is good, the reliability and stability of data transmission is improved.

Figure 6A:
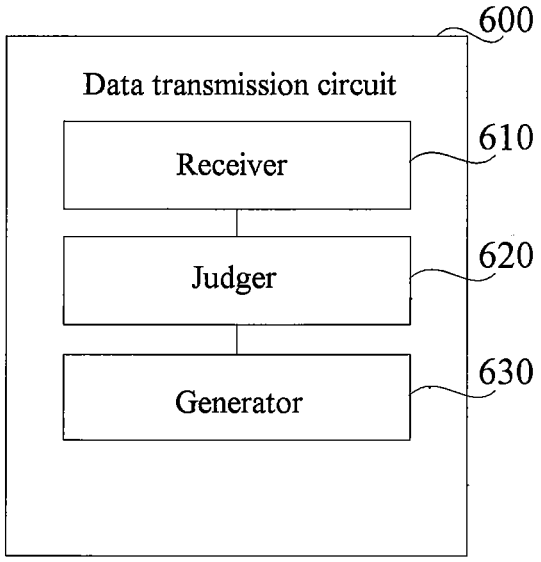
FIG. 6*a* is a structure diagram of still another data transmission circuit provided by an embodiment of the disclosure.

An embodiment of the disclosure provides another data transmission circuit for any of the source drivers 200 in the application environment as shown in FIG. 1, as shown in FIG. 6*a*, the data transmission circuit 600 including:

a receiver 610 for receiving a link stability check data sent by a timing controller after clock calibration;

a judger 620 for judging whether the received link stability check data is correct; and a generator 630 for generating feedback information when the received link stability check data is correct, and sending the feedback information to the timing controller, such that the timing controller sends target data to the source driver based on the feedback information.

From the above, in the data transmission circuit provided by the embodiment of the disclosure, the source driver receives the link stability check data sent by the timing controller after clock calibration, and when the link stability check data received by the source driver is correct, which indicates that the data transmission state of the link is good, the source driver sends feedback information to the timing controller, such that the timing controller can send data to the source driver in a case in which the data transmission state of the link is good, so the reliability and stability of data transmission is improved.

Exemplarily, the link stability check data is obtained by encoding a multiple byte data code adopting an 8b/10b encoding approach, the multiple byte data code includes a start identification and data digits, the start identification is used for indicating start of data transmission, the data digits carry verification data, a scrambling identification is arranged in the data digits, a position of the scrambling identification is used for indicating a port of the source driver and an initialization time point of an LFSR corresponding to the port, and the LFSR is used for scrambling of the target data.

Exemplarily, the multiple byte data code is a data code of 40 bytes, the start identification is a K2 code of 4 bytes, the scrambling identification is a K3 code of 4 bytes, the verification data carried by the data digits includes 8 data units, each of the data units includes a data code of 4 bytes, and there exists at least a data code of 4 bytes between the start identification and the scrambling identification.

Exemplarily, the receiver 610 is specifically used for: receiving for a duration of 1 microsecond the link stability check data sent n times by the timing controller, n being greater than or equal to 5.

Figure 6B:
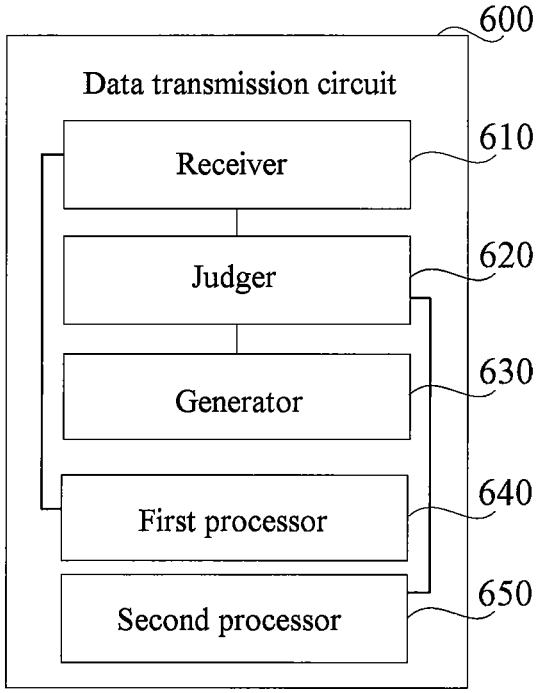
FIG. 6*b* is a structure diagram of yet still another data transmission circuit provided by an embodiment of the disclosure.

Further, as shown in FIG. 6*b*, the data transmission circuit 600 may further include: a first processor 640 for stopping receiving the link stability check data when the link stability check data containing an interruption identification sent by the timing controller is received, the link stability check data containing an interruption identification being generated by the timing controller when receiving a transmission interruption instruction.

Further, as shown in FIG. 6*b*, the data transmission circuit 600 may further include: a second processor 650 for repeatedly performing a phase calibration operation when the received link stability check data is incorrect, until a correct link stability check data is received.

Exemplarily, the judger 620 is specifically used for: decoding the received link stability check data to obtain decoded data, wherein the decoded data includes the scrambling identification; judging whether the decoded data is the same as the multiple byte data code; determining that the received link stability check data is correct when the decoded data is the same as the multiple byte data code; and determining that the received link stability check data is incorrect when the decoded data is different from the multiple byte data code.

Exemplarily, the judger 620 is further used for: determining the port of the source driver and the initialization time point of the LFSR corresponding to the port according to the position of the scrambling identification in the decoded data; and initializing the LFSR for the port according to the initialization time point.

From the above, in the data transmission circuit provided by the embodiment of the disclosure, the source driver receives the link stability check data sent by the timing controller after clock calibration, and when the link stability check data received by the source driver is correct, which indicates that the data transmission state of the link is good, the source driver sends feedback information to the timing controller, such that the timing controller can send data to the source driver in a case in which the data transmission state of the link is good, so the reliability and stability of data transmission is improved.

Various techniques may be described herein in the general context of software, hardware elements, or program modules. Generally, such modules include routines, programs, objects, elements, components, data structures, and so forth that perform particular tasks or implement particular abstract data types. The terms "module," "functionality," and "component" or similar ones as used herein generally represent software, firmware, hardware, or a combination thereof. The features of the techniques described herein are platform-independent, meaning that the techniques may be implemented on a variety of computing platforms having a variety of processors.

An embodiment of the disclosure further provides a display device including a timing controller and a source driver.

Therein, the timing controller includes a data transmission circuit as shown in FIG. 5*a* or FIG. 5*b*, and the source driver includes a data transmission circuit as shown in the FIG. 6*a* or FIG. 6*b*.

The display device may be any product or component with the display function, such as a liquid crystal panel, an electronic paper, an organic light emitting diode (OLED for short) panel, a mobile phone, a tablet computer, a television, a display, a notebook computer, a digital photo frame, a navigator, etc.

An embodiment of the disclosure further provides a computer readable non-transitory storage medium storing an instruction therein, which, when running on a computer, causes the computer to perform a data transmission method as shown in FIG. 2 or FIG. 4*a*.

An embodiment of the disclosure further provides a computer readable non-transitory storage medium storing an instruction therein, which, when running on a computer, causes the computer to perform a data transmission method as shown in FIG. 3 or FIG. 4*a*.

It may be clearly understood by the person having skills in the art that, for convenience and brevity of description, specific working procedures of the devices and components described above may be referred to corresponding procedures in the above method embodiments, which will not be repeated here any longer.

Other implementation schemes of this application will easily occur to the person having skills in the art after considering the specification and practicing the invention disclosed herein. This application aims at covering any variations, uses or adaptations of this application, and these variations, uses or adaptations follow the general principles of this application and include common sense or common technical means in the art which is not disclosed by this application. The specification and the embodiments are simply deemed as exemplary, and the true scope and spirit of this application are pointed out by the claims.

It should be understood that, this application is not limited to the precise structures described above and shown in the drawings, and various modifications and changes may be made without departing from its scope. The scope of this application is only limited by the appended claims.

What is claimed is:

1. A data transmission method for a timing controller, the method comprising:

sending link stability check data to a source driver after clock calibration;

receiving feedback information sent by the source driver, wherein the feedback information is generated by the source driver when judging that the link stability check data that was received is correct; and sending target data to the source driver based on the feedback information, wherein the link stability check data is obtained by encoding a multiple byte data code adopting an 8b/10b encoding approach, wherein the multiple byte data code comprises a start identification and data digits, wherein the start identification is used for indicating start of data transmission, the data digits carry verification data, a scrambling identification is arranged in the data digits, a position of the scrambling identification is used for indicating a port of the source driver and an initialization time point of a linear feedback shift register (LFSR) corresponding to the port, and the LFSR is used for scrambling of the target data, wherein the multiple byte data code is a data code of 40 bytes, wherein the start identification is a K2 code of 4 bytes, wherein the scrambling identification is a K3 code of 4 bytes, wherein the verification data carried by the data digits comprises 8 data units, wherein each of the 8 data units comprises a data code of 4 bytes, and wherein at least a data code of 4 bytes are between the start identification and the scrambling identification.

2. The method as claimed in claim 1, wherein the sending the link stability check data to the source driver comprises:

sending the link stability check data to the source driver when the timing controller is to enter a low power consumption wake-up state, wherein the low power consumption wake-up state is a transitional state in which the timing controller reenters a data transmission state from the low power consumption wake-up state with no need for data transmission.

3. The method as claimed in claim 1, wherein after the sending the link stability check data to the source driver, the method further comprises:

generating the link stability check data comprising an interruption identification in response to receiving a transmission interruption instruction; and sending the link stability check data comprising the interruption identification to the source driver, to instruct the source driver to stop receiving the link stability check data, wherein the interruption identification is a K1 code or a K4 code.

4. A data transmission method for a source driver, the method comprising:

receiving the link stability check data sent by a timing controller of claim 1 after clock calibration;

judging whether the link stability check data that was received is correct;

generating feedback information in response to the link stability check data that was received being correct; and sending the feedback information to the timing controller, such that the timing controller sends target data to the source driver based on the feedback information, wherein the link stability check data is obtained by encoding a multiple byte data code adopting an 8b/10b encoding approach, wherein the multiple byte data code comprises a start identification and data digits, wherein the start identification is used for indicating start of data transmission, the data digits carry verification data, a scrambling identification is arranged in the data digits, a position of the scrambling identification is used for indicating a port of the source driver and an initialization time point of a linear feedback shift register (LFSR) corresponding to the port, and the LFSR is used for scrambling of the target data, wherein the multiple byte data code is a data code of 40 bytes, wherein the start identification is a K2 code of 4 bytes, wherein the scrambling identification is a K3 code of 4 bytes, wherein the verification data carried by the data digits comprises 8 data units, wherein each of the 8 data units comprises a data code of 4 bytes, and wherein at least a data code of 4 bytes are between the start identification and the scrambling identification.

5. The method as claimed in claim 4, wherein after the receiving the link stability check data sent by the timing controller after clock calibration, the method further comprises:

stopping receiving the link stability check data in response to receiving the link stability check data comprising an interruption identification sent by the timing controller, the link stability check data comprising the interruption identification being generated by the timing controller when receiving a transmission interruption instruction.

6. The method as claimed in claim 4, wherein the judging whether the link stability check data that was received is correct comprises:

decoding the link stability check data that was received to obtain decoded data, wherein the decoded data comprises the scrambling identification;

judging whether the decoded data is same as the multiple byte data code;

determining that the link stability check data that was received is correct in response to the decoded data being the same as the multiple byte data code; and determining that the link stability check data that was received is incorrect in response to the decoded data being different from the multiple byte data code.

7. The method as claimed in claim 6, wherein after the determining that the link stability check data that was received is correct, the method further comprises:

determining the port of the source driver and the initialization time point of the linear feedback shift register (LFSR) corresponding to the port according to the position of the scrambling identification in the decoded data; and initializing the LFSR for the port according to the initialization time point.

8. A computer readable non-transitory storage medium storing an instruction therein which, when running on a computer, causes the computer to perform the data transmission method as claimed in claim 4.

9. A data transmission circuit for a source driver, the data transmission circuit comprising:

a receiver configured to receive the link stability check data sent by the timing controller of claim 1 after clock calibration;

a judger configured to judge whether the link stability check data that was received is correct; and a generator configured to generate feedback information in response to the judgment that the link stability check data that was received is correct, and configured to send the feedback information to the timing controller, such that the timing controller sends target data to the source driver based on the feedback information.

10. The data transmission circuit as claimed in claim 9, wherein the data transmission circuit further comprises:

a first processor configured to stop receiving the link stability check data when the link stability check data comprising an interruption identification sent by the timing controller is received, the link stability check data comprising an interruption identification being generated by the timing controller when receiving a transmission interruption instruction.

11. The data transmission circuit as claimed in claim 9, wherein the judger is specifically used for operations comprising:

decoding the link stability check data that was received to obtain decoded data, wherein the decoded data comprises an scrambling identification;

judging whether the decoded data is same as a multiple byte data code;

determining that the link stability check data that was received is correct in response to the decoded data being the same as the multiple byte data code; and determining that the link stability check data that was received is incorrect in response to the decoded data being different from the multiple byte data code, wherein the link stability check data is obtained by encoding the multiple byte data code adopting an 8b/10b encoding approach, wherein the multiple byte data code comprises a start identification and data digits, wherein the start identification is used for indicating start of data transmission, the data digits carry verification data, the scrambling identification is arranged in the data digits, a position of the scrambling identification is used for indicating a port of the source driver and an initialization time point of a linear feedback shift register (LFSR) corresponding to the port, and the LFSR is used for scrambling of the target data, wherein the judger is further used for operations comprising:

determining the port of the source driver and the initialization time point of the linear feedback shift register (LFSR) corresponding to the port according to the position of the scrambling identification in the decoded data; and initializing the LFSR for the port according to the initialization time point.

12. A computer readable non-transitory storage medium storing an instruction therein which, when running on a computer, causes the computer to perform the data transmission method as claimed in claim 1.

13. A data transmission circuit for a timing controller, the data transmission circuit comprising:

a first sender configured to send link stability check data to a source driver after clock calibration;

a receiver configured to receive feedback information sent by the source driver, wherein the feedback information is generated by the source driver when judging that the link stability check data that was received is correct; and a second sender configured to send target data to the source driver based on the feedback information, wherein the link stability check data is obtained by encoding a multiple byte data code adopting an 8b/10b encoding approach, wherein the multiple byte data code comprises a start identification and data digits, wherein the start identification is used for indicating start of data transmission, the data digits carry verification data, a scrambling identification is arranged in the data digits, a position of the scrambling identification is used for indicating a port of the source driver and an initialization time point of a linear feedback shift register (LFSR) corresponding to the port, and the LFSR is used for scrambling of the target data, wherein the multiple byte data code is a data code of 40 bytes, wherein the start identification is a K2 code of 4 bytes, wherein the scrambling identification is a K3 code of 4 bytes, wherein the verification data carried by the data digits comprises 8 data units, wherein each of the 8 data units comprises a data code of 4 bytes, and wherein at least a data code of 4 bytes is between the start identification and the scrambling identification.

14. The data transmission circuit as claimed in claim 13, wherein the first sender is specifically used for sending the link stability check data to the source driver when the timing controller is to enter a low power consumption wake-up state, and wherein the low power consumption wake-up state is a transitional state in which the timing controller reenters a data transmission state from the low power consumption wake-up state with no need for data transmission.

15. The data transmission circuit as claimed in claim 13, wherein the data transmission circuit further comprises:

a generator configured to generate the link stability check data comprising an interruption identification when a transmission interruption instruction is received; and a third sender for sending the link stability check data comprising the interruption identification to the source driver, to instruct the source driver to stop receiving the link stability check data, wherein the interruption identification is a K1 code or a K4 code.

16. A display device comprising a timing controller and a source driver, wherein the timing controller comprises a data transmission circuit as claimed in claim 13, and wherein the source driver comprises a data transmission circuit, comprising:

a receiver configured to receive the link stability check data sent by a timing controller after clock calibration, a judger configured to judge whether the link stability check data that was received is correct, and a generator configured to generate feedback information in response to the judgment that the link stability check data that was received is correct, and configured to send the feedback information to the timing controller, such that the timing controller sends target data to the source driver based on the feedback information.

* * * * *